US009410332B2

(12) United States Patent
Patton et al.

(10) Patent No.: US 9,410,332 B2
(45) Date of Patent: Aug. 9, 2016

(54) VARIABLE HEIGHT ATTACHMENT POINT SYSTEM FOR A SAFETY HARNESS

(71) Applicant: Honeywell International Inc., Morristown, NJ (US)

(72) Inventors: Justin S. Patton, Franklin, PA (US); Preston L. Anderson, Cranberry, PA (US); Brian Montgomery, Mercer, PA (US); Alex Tsen, Toronto (CA); William Zachar, Meadville, PA (US)

(73) Assignee: Honeywell International Inc., Morris Plains, NJ (US)

( * ) Notice: Subject to any disclaimer, the term of this patent is extended or adjusted under 35 U.S.C. 154(b) by 13 days.

(21) Appl. No.: 13/633,844

(22) Filed: Oct. 2, 2012

(65) Prior Publication Data

US 2014/0090927 A1 Apr. 3, 2014

(51) Int. Cl.

| | |
|---|---|
| ***A62B 35/00*** | (2006.01) |
| ***E04G 5/00*** | (2006.01) |
| ***E04G 21/32*** | (2006.01) |

(52) U.S. Cl.

CPC ..... *E04G 5/001* (2013.01); *A62B 35/005* (2013.01); *A62B 35/0068* (2013.01); *E04G 21/3261* (2013.01)

(58) Field of Classification Search

CPC ..... A62B 35/00; A62B 35/0043; A62B 35/0068; A62B 35/005; E04G 21/3276; E04G 21/32; E04G 21/3204; E04G 21/3214; E04G 21/3219; E04G 21/3233; E04G 21/328; E04G 21/3285; E04G 21/3261; E04G 5/001

USPC ..... 182/3, 112

See application file for complete search history.

(56) References Cited

U.S. PATENT DOCUMENTS

| | | | | | |
|---|---|---|---|---|---|
| 2,569,821 | A | * | 10/1951 | Maxeiner | 248/237 |
| 2,845,243 | A | * | 7/1958 | Mowers et al. | 248/536 |
| 3,940,099 | A | * | 2/1976 | McCleskey | 248/511 |
| 3,952,836 | A | * | 4/1976 | Thoma | 187/259 |
| 4,151,534 | A | | 4/1979 | Bond | |
| 4,171,032 | A | * | 10/1979 | Woolslayer et al. | 182/3 |
| 4,607,724 | A | * | 8/1986 | Hillberg | 182/3 |
| 4,838,439 | A | * | 6/1989 | Baziuk | 212/179 |
| 4,852,692 | A | * | 8/1989 | Flaherty | 340/573.1 |

(Continued)

FOREIGN PATENT DOCUMENTS

| | | |
|---|---|---|
| WO | WO9826842 | 6/1998 |
| WO | WO9955425 | 11/1999 |

(Continued)

OTHER PUBLICATIONS

Brochure, Rescue Davit Arm Model DH-AP-3, 2 pages, date unknown, Miller by Sperian, www.millerfallprotection.com.

(Continued)

*Primary Examiner* — Daniel Cahn
*Assistant Examiner* — Shiref Mekhaeil
(74) *Attorney, Agent, or Firm* — Craige Thompson; Thompson Patent Law

(57) ABSTRACT

Systems and methods relate to a operator selectable, variable-height attachment point system for a safety harness, where the attachment point is disposed on a radial support member that can be reversibly coupled to a vertical support member, and where the attachment point height can be selected by the operator by reversing a coupled orientation of the radial support member to the vertical support member.

13 Claims, 20 Drawing Sheets

(56) References Cited

U.S. PATENT DOCUMENTS

| | | | | |
|---|---|---|---|---|
| 4,942,943 | A * | 7/1990 | Flaherty | 182/231 |
| 5,233,809 | A | 8/1993 | Gropper | |
| 5,295,500 | A * | 3/1994 | Leu | 135/88.06 |
| 5,341,898 | A * | 8/1994 | Baziuk | 182/142 |
| 5,622,237 | A * | 4/1997 | Moldow | 182/37 |
| 5,730,246 | A * | 3/1998 | Beard | E04G 21/3261 182/3 |
| 5,911,399 | A * | 6/1999 | Mannion | 248/514 |
| 6,695,095 | B1 * | 2/2004 | Franke | 182/3 |
| 7,032,710 | B2 * | 4/2006 | Anderson et al. | 182/16 |
| 7,363,875 | B2 * | 4/2008 | Vetesnik | 116/212 |
| D570,071 | S | 5/2008 | Campbell et al. | |
| 7,537,085 | B2 * | 5/2009 | Vetesnik | 182/3 |
| 7,828,116 | B2 * | 11/2010 | Vetesnik | 182/18 |
| 8,100,227 | B2 * | 1/2012 | Southworth | 182/130 |
| 8,616,332 | B2 * | 12/2013 | Witlam et al. | 182/3 |
| 2002/0185335 | A1 * | 12/2002 | Verdyk | 182/3 |
| 2003/0047382 | A1 * | 3/2003 | Panacci | 182/113 |
| 2003/0173149 | A1 * | 9/2003 | Anderson et al. | 182/3 |
| 2004/0195041 | A1 * | 10/2004 | Vetesnik | 182/3 |
| 2005/0034920 | A1 * | 2/2005 | Anderson | 182/3 |
| 2005/0161284 | A1 * | 7/2005 | Casebolt et al. | 182/3 |
| 2006/0163002 | A1 * | 7/2006 | Langsmead | 182/113 |
| 2006/0289233 | A1 * | 12/2006 | Flaherty | 182/45 |
| 2010/0126801 | A1 * | 5/2010 | Begin et al. | 182/3 |
| 2011/0042165 | A1 | 2/2011 | Griffith | |
| 2011/0226548 | A1 | 9/2011 | Witlam et al. | |
| 2014/0076659 | A1 * | 3/2014 | Terry | 182/13 |

FOREIGN PATENT DOCUMENTS

| | | |
|---|---|---|
| WO | WO01/26738 | 4/2001 |
| WO | WO2007071015 | 6/2007 |
| WO | WO2010/111734 | 10/2010 |

OTHER PUBLICATIONS

Brochure Combisafe by Alsipercha Fall Arrest System, 2 pages, www.combisafe.com, date unknown.

Brochure, Combisafe Loading System, Art. Nos. 83310/83320, 2 pages, www.combisafe.com, date unknown.

* cited by examiner

VARIABLE HEIGHT ATTACHMENT POINT SYSTEM FOR A SAFETY HARNESS

TECHNICAL FIELD

Various embodiments relate generally to variable-height attachment point assemblies for cooperative use with safety harnesses and the like.

BACKGROUND

Safety harnesses are widely used by persons working on elevated structures to catch the person in the event of a fall. Workers can be seriously injured or killed from falls, which may be the result of being struck by moving machinery or structural members, or simply losing their balance. In some cases, construction workers may wear a safety harness that includes a tether that can be attached to a stable structural member, such as an I-beam or a joist when they are working at elevated heights. Thus, if a worker does fall, their descent may be generally limited to the length of the tether.

SUMMARY

Systems and methods relate to an operator selectable, variable-height attachment point system for a safety harness, where the attachment point is disposed on a radial support member that can be reversibly coupled to a vertical support member, and where the attachment point height can be selected by the operator by reversing a coupled orientation of the radial support member to the vertical support member.

In an exemplary embodiment, a variable-height attachment point system for a safety harness may include an elongate vertical support member configured to receive and reversibly couple to an elongate radial support member. The radial support member may extend, for example, substantially radially from an end section of the vertical support member. In some examples, the radial support member may include bends at each end section where the bend angles are different from each other. The unequal bends in the radial support member may allow, for example, the orientation of the radial support member relative to the vertical support member to be selected by an operator. Each end section of the radial support member may include an attachment point for a safety harness, such as an aperture configured to receive a safety harness tether or a similar article, for example. In various embodiments, an operator may position a safety harness attachment point at a desired height from a working surface by selection of which end of the radial support member to couple to the vertical support member.

In accordance with another exemplary embodiment, a variable-height attachment point system for a safety harness includes a base configured to receive the elongate vertical support member. In certain embodiments, the base can be a cage-like structure capable of stabilizing the vertical support member in different ways. For example, in one embodiment, the base can be configured for receiving counterweights that provide structural stability of the attachment point system. In another embodiment, the base can be configured so that a portion of the base can receive the weight of a vehicle tire. In yet another embodiment, the base can be configured to be sunken into malleable cement so as to provide a stable footing into which an end portion of the vertical member can be inserted.

In various embodiments, the components of a variable-height attachment point system can be modular, providing the capability to build the system to a preferred working height above a surface.

In accordance with another exemplary embodiment, a variable-height attachment point system for a safety harness may include a radial support member capable of absorbing unintended forces imparted to the system so as to protect a person tethered thereto, and the system itself. For example, in one embodiment, a radial support member can include a breakaway hinge configured to hingedly give way to an unintended force applied to a distal end portion of the radial support member. Such unintended forces can result from, for example, moving machinery, falling debris, or structural members of a building being moved by other machinery.

Various embodiments may achieve one or more advantages. For example, some embodiments may allow a user to easily select between at least two attachment point heights for connecting a tether of a safety harness. In some implementations, variable height selection of the attachment point may be accomplished with a minimum number of components. Various embodiments can be useful, for example, when a user is working above a surface at multiple heights. Another advantage of some embodiments may include the ability to lift a fall-arresting system of the type described herein using a common (e.g., low load capacity, light duty) forklift. Yet another advantage includes the relatively lightweight nature of the system components, which can allow a user to select between at least two attachment point heights without requiring lifting machinery to do so.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, one embodiment of a variable-height attachment point system for a safety harness is briefly introduced with reference to FIG. 1. Second, with reference to FIGS. 2-3B, various components of a variable-height attachment point system are described. Next, with reference to FIGS. 4-6, the discussion turns to exemplary embodiments that illustrate various implementations of variable-height attachment point systems. Finally, FIG. 7 introduces a variable-height attachment point system having a breakaway hinge feature that provides shock-reducing advantages during a fall arrest.

Figure 1:
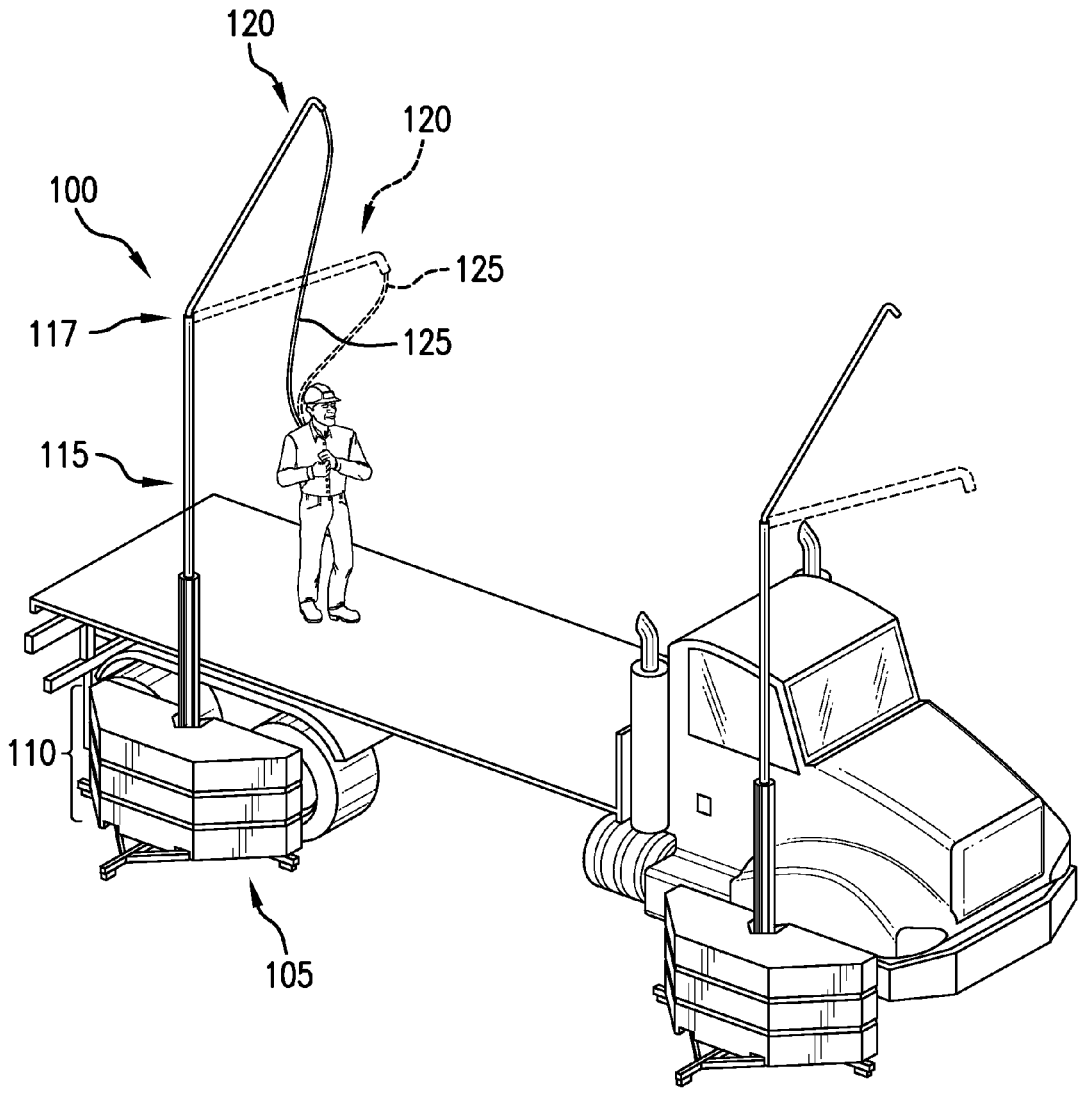
FIG. 1 depicts a variable-height attachment point system according to one embodiment.

FIG. 1 shows a variable-height attachment point system 100 (hereinafter "system") according to one embodiment. While not necessarily part of the attachment point system 100, FIG. 1 depicts a user working on an elevated structure, in this case, the bed of a trailer to illustrate one functional aspect of the system 100.

In this embodiment, the system 100 includes a base 105 configured to securely receive an end section of an elongate vertical support member 115. The base 105 can be a portable cage structure that provides structural support for the system 100 in a substantially upright and operable configuration as generally depicted in FIG. 1. As discussed in greater detail below, specifically with respect to FIGS. 5A-5E, the base 105 can be configured to support weights 110 that can assist in stabilizing the system 100 in a substantially upright and operable configuration. Likewise, the base 105 can include a section configured to allow one or more tires of a tractor-trailer to be parked thereon, which can provide additional stabilization of the system 100. In this and other embodiments, the base 105 may be any of the bases illustrated and described with respect to FIG. 5D, including alternative variations thereof.

In this embodiment, the elongate, vertical support member 115 includes a second end section 117 configured to securely receive a radial support member 120. The vertical support member 115 can be formed as a single material piece, or, in some embodiments, can be formed from a plurality of structural members as described in greater detail below, specifically with respect to FIGS. 5A-5E. In general, the vertical support member 115 can extend orthogonally from the plane of the base as shown.

In the depicted embodiment, the radial support member 120 includes two oppositely-disposed end sections as described in greater detail below, each of which is configured to be securely inserted into the second end section 117 of the vertical support member 115. Each of the end sections of the radial support member 120 provides an attachment point for a tether 125 of a safety harness assembly. Furthermore, each of the end sections of the radial support member 120 includes bends near to the terminal end at each side. In this embodiment, the bends are formed at different angles from each other; accordingly, the radial support member 120 can be oriented at different angles with respect to the vertical support member 115, depending on which end section of the radial support member is inserted into the second end section 117 of the vertical support member. FIG. 1 illustrates such functionality by depicting the radial support member in a first orientation as a solid line, and in a second orientation as a dashed line.

Still referring to FIG. 1, in this embodiment, the worker can select a desired attachment point height for his tether 125 by selecting either of two radial support member 120 orientations with respect to the vertical support member 115. For example, if the worker is working on an empty flatbed trailer (as depicted), he may chose to select the radial support member 120 orientation that provides the lowest attachment point (depicted as the dashed line in FIG. 1). Alternatively, if, for example, the worker is working on top of a trailer load, he may elect the radial support member 120 orientation that provides the higher attachment point (depicted as the solid line in FIG. 1). The worker can switch back and forth between radial support member 120 orientations as desired to provide the safest work condition configuration.

Figure 2A:
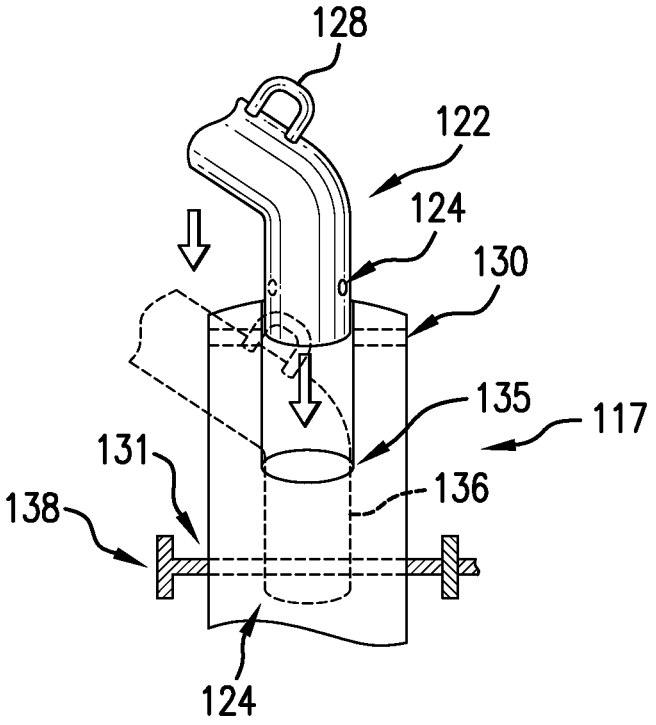
FIGS. 2A-2B depict various components of a variable-height attachment point system according to one embodiment.
Figure 2B:
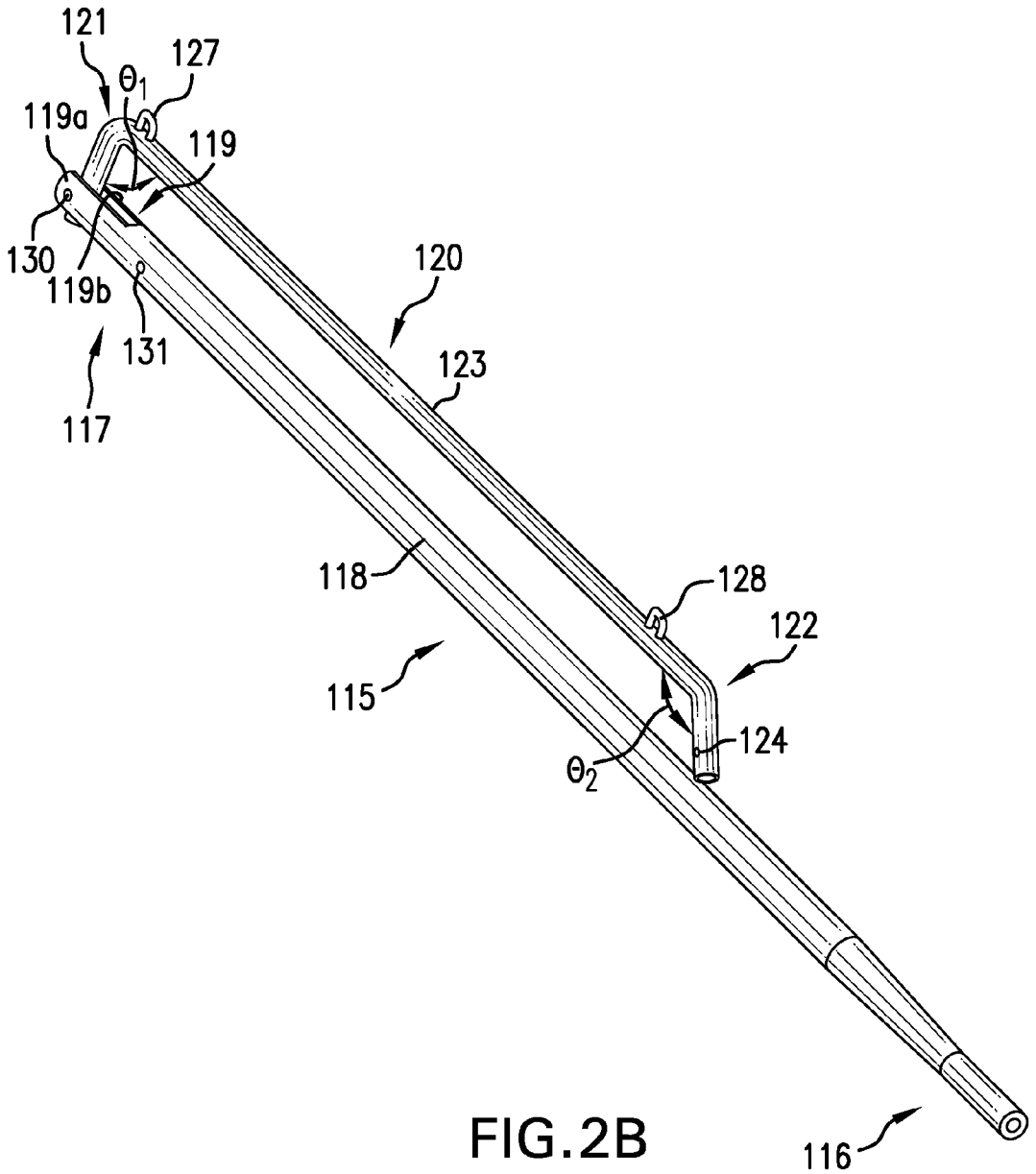

Referring now to FIGS. 2A-2B, the vertical support member 115 and the radial support member 120 are shown in greater detail. FIG. 2B shows the vertical support member 115 and the radial support member 120 coupled in a collapsed configuration, which can be used, e.g., for transport or storage. In this embodiment, the vertical support member 115 includes an elongate central member 118 having a first end section 116 and a second end section 117, respectively. In this embodiment, the central member 118 is formed from tubular steel material. In some embodiments, the central member may be formed of other materials, (e.g., plastics, composites) according to preference, manufacturing considerations, structural rigidity, and/or maximum loading, for example.

The first end 116 of the vertical support member 115 is configured to be inserted into the base 105 as previously described. In this embodiment, the first end 116 is tapered so as to fit in a complementary receptacle in the base 105. Attachment of the vertical support member 115 to the base 105 can be accomplished using various fastening members, including, but not limited to bolts, screws, nails, dowels, and the like. In one embodiment, the base 105 includes a cylindrically-shaped receptacle configured to receive substantially all of the first end section 116.

The second end 117 of the elongate vertical support member 115 is configured to receive an end section of the radial support member 120 as previously described. In this embodiment, the radial support member 120 includes first and second oppositely-situated end sections 121, 122, respectively, spanned by an elongate central member 123 that is substantially coplanar with the end section 121, 122, and defines a radial axis. In this embodiment, each of the end sections 121, 122, includes a bend in the central member 123 at first and second bend angles $\theta_1$ and $\theta_2$ respectively, where $\theta_1 \neq \theta_2$. For example, either of the end sections 121, 122 can be bent at an angle between about 80° and about 150°, e.g., about 80, 90, 100, 110, 120, 130, 140, or 150 degrees. In some examples, one of the angles may be acute, and the other may be obtuse, to provide a substantial height differential at the attachment point, depending on which of the end sections 121, 122 is coupled to the vertical support member 115.

In this embodiment, each of the end sections 121, 122, is configured to provide an attachment point for a tether member of a safety harness system. In this embodiment, the attachment point in each end section 121, 122 is an aperture, e.g., aperture 124, through which a user can tie, or otherwise anchor the tether portion of a safety harness. It will be understood that end section 121 in FIG. 2B similarly includes an aperture, although it is not expressly illustrated so as to show the vertical support member 115 and the radial support member 120 in a coupled configuration.

In this embodiment, the radial support member 120 further includes a connector member 127, 128 respectively, on each end section 121, 122. Here, the connector members 127, 128 are U-shaped members integral with, or securely fastened to the central member 123 that provides a lifting point for the vertical support member 115 and radial support member 120 when in a coupled configuration. In this embodiment, the position of the connector members 127, 128 may be disposed at or substantially near a center of gravity of the vertical support member 115 and radial support member 120 combination, when coupled in an operable configuration, e.g., as illustrated in FIG. 1. When lifted by lifting equipment, the attachment point positioned at or substantially near the center of gravity, as just described, may advantageously help to maintain the vertical support member 115 in a substantially vertical orientation to promote coupling to the base 105, for example. In an illustrative example, the attachment point may be positioned proximate a center of gravity of a combination of the vertical support member coupled to the radial support member such that the vertical support member hangs substantially parallel (e.g., less than about 15, 10, or about 5 degrees) with respect to a gravity vector when the combination is lifted at said attachment point. Some embodiments may facilitate insertion and/or coupling to a base when the vertical support member is hanging substantially perpendicular to the ground, for example.

In this embodiment, the second end 117 of the vertical support member 115 includes a U-shaped notch, referred to by reference number 119, which is defined in part by opposing wall members 119*a*, 119*b* of the central member 118 as shown. In this embodiment, each of the wall members 119*a*, 119*b* includes an aperture 130 configured to receive a fastening member such as a bolt, cotter pin, dowel, or similar member capable of passing through the central member 118 and the aperture of either end section 121, 122 of the radial support member 120, e.g., aperture 124.

Referring to FIG. 2A, in this embodiment, the vertical support member 115 and the radial support member 120 can be coupled in an operable configuration (e.g., as shown in FIG. 1) by inserting an end section, e.g., end section 122 of the radial support member 120, into a cylindrical recess 135 defined by the interior wall 136 of the central member 118. In FIG. 2B, the end section 122 depicted by the solid line illustrates a pre-insertion position, and the dashed line illustrates the end section 122 in a coupled, operable position. In this embodiment, the elongate vertical support member 117 includes a second set of apertures 131 similarly configured to receive a fastening member 138 capable of passing through the central member and simultaneously through the aperture of either end section, e.g., through aperture 124 of end section 122. Exemplary fastening members 138 include, but are not limited to: bolts, cotter pins, dowels, or similar members. It can be preferable for ease of use of the system 100, that the position of the tether attachment points on each end section of the radial support member 123 align with the second set of apertures 131 in the vertical support member when the two members 115, 120 are coupled in an operative configuration, e.g., the configuration shown in FIG. 1 or 3A.

Figure 3A:
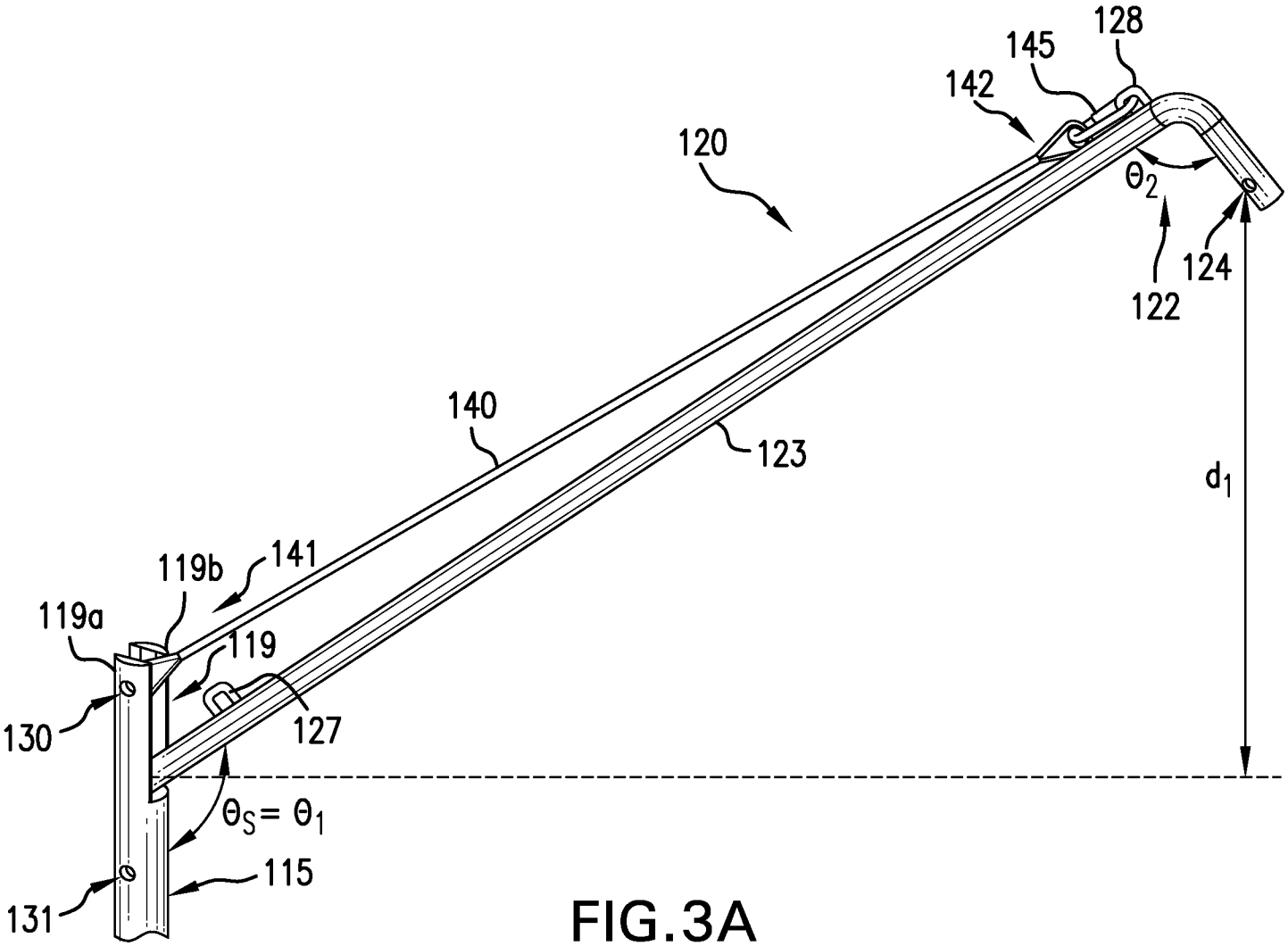
FIGS. 3A-3B depict a variable-height attachment point system in two configurations, according to one embodiment.

Referring now to FIG. 3A, the vertical support member 115 and the radial support member 120 are shown assembled in an operative and coupled configuration, according to one embodiment. In this embodiment, the first end section 121 of the radial support member 120 is shown inserted into the recess 119 of the vertical support member 115, which orients the radial support member 120 at an angle $\theta_S$ (system angle) with respect to the vertical axis of the vertical support member 115 (illustrated in FIG. 3A as a dotted line). In general, if the clearance between the inserted end section of the radial support member 120 and the recess of the vertical support member 115 is minimized, then the system angle $\theta_S$ will be approximately equal to the bend angle of the inserted end section 121, e.g., $\theta_S=\theta_1$ as illustrated.

In this embodiment, a guy 140 is coupled to the second end section 117 of the vertical support member 115 at one end, and coupled to the connector member (in this case connector member 128) at the free (non-inserted) end 122 of the radial support member 120. The guy 140 can be connected to either coupling point using bolts, dowels, pins, or other types of fastening mechanisms known in the art. In this example, the guy 140 is coupled to connector member 128 using a carabineer 145, which is one of many coupling options. The guy 140 can provide additional stability for the system 100; for example, the guy 140 can increase resistance to moment forces at the inserted end of the radial support arm 120 (e.g., end 121) when downward forces are applied at the free end, e.g., end section 122 as illustrated in FIG. 3A. In various embodiments, the guy can be a wire, rope, or other member capable of providing additional structural stability to the system 100.

Figure 3B:
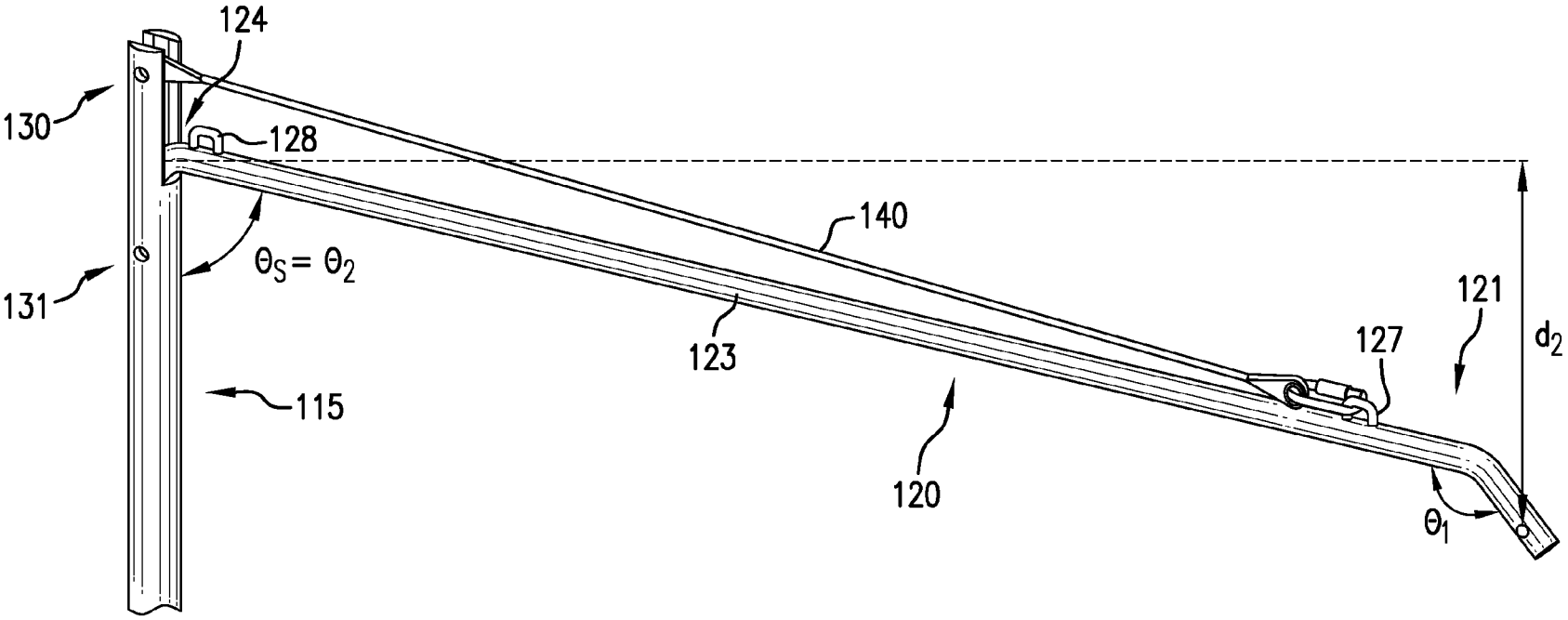

The capability of the system 100 to provide a variable-height attachment point for a safety harness tether member is exemplified in FIGS. 3A and 3B. Referring first to FIG. 3A, the system angle $\theta_S$ is approximately equal $\theta_1$, the bend angle of the first end section 121 of the radial support member 120. The distance $d_1$ of the safety harness tether attachment point, e.g., aperture 124 above or below a horizontal plane running through the recess 119 will correspondingly depend on the bend angle $\theta_1$ (wherein the horizontal plane is shown as a dashed line in FIG. 3A).

Referring now to FIG. 3B, the orientation of the radial support member 120 has been reversed with respect to FIG. 3A, where now the second end section 122 has been placed in the recess 119. Because $\theta_1 \neq \theta_2$, the distance $d_2$ of the safety harness tether attachment point from the horizontal plane running through the recess 119 is different than $d^1$; in this case, $d_2$ is slightly below the horizontal plane illustrated by the dashed line. Thus, the height of the safety tether attachment point from a working surface can be varied according to the orientation of the radial support member, including the height of the vertical support member 115.

Figure 4:
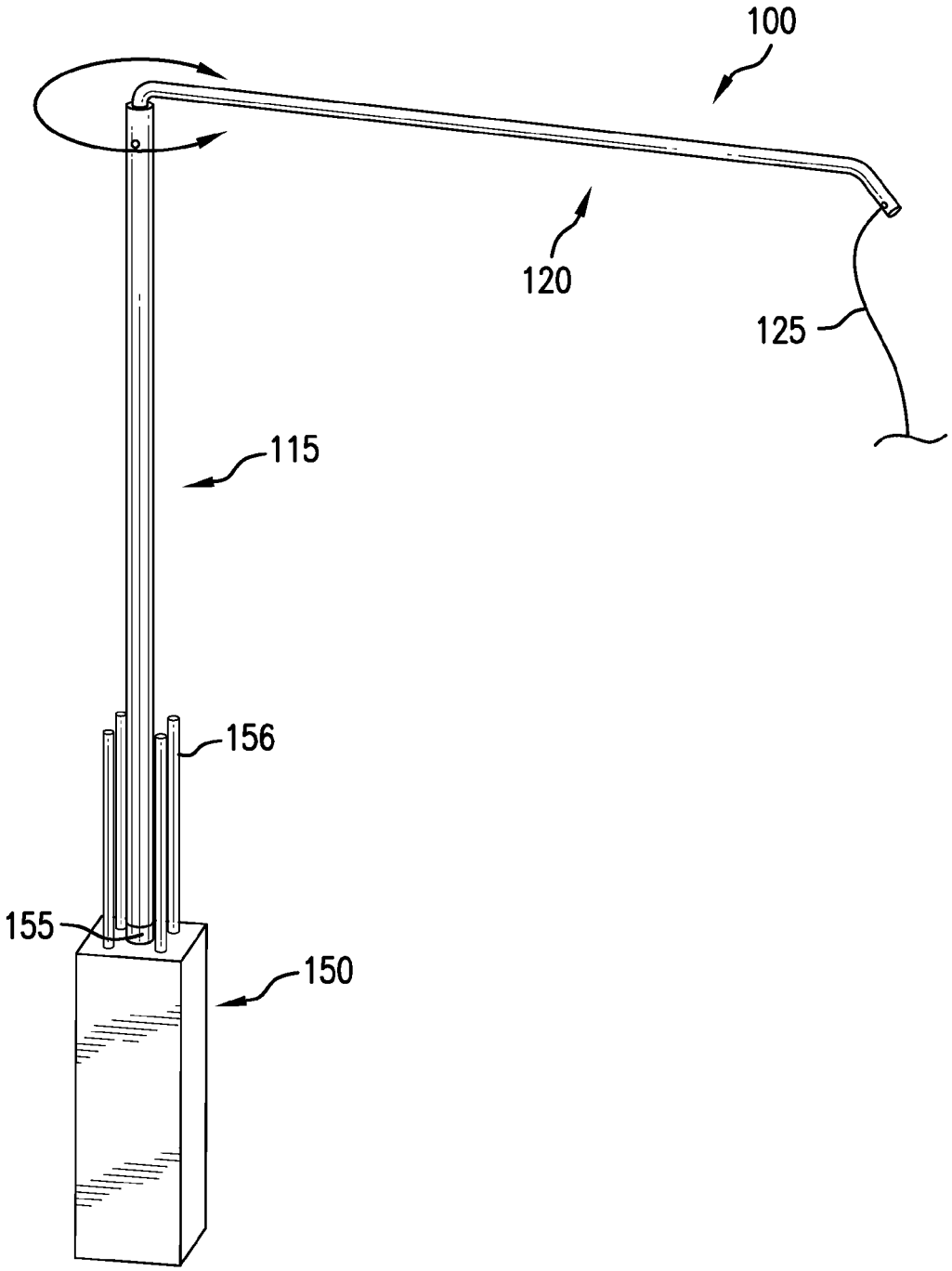
FIG. 4 depicts a variable-height attachment point system according to one embodiment.

Referring now to FIG. 4, the system 100 can be used in decking applications. For example, when constructing tall structures it is a common approach to build a structural framework on which workers can walk and perform various tasks. One such approach includes pouring concrete columns in a step-wise manner as floors are added vertically to the structure. In this embodiment, a footer 155 that is configured to receive and secure the first end 116 of the vertical support member 115 can be set into pre-hardened concrete of a structural support column 150. In one approach, the footer 155 can be set in the middle of the column 150, so it does not interfere with the placement of rebar 156 or other structural support members.

In this embodiment, the second end 117 of the vertical support member 115 is configured to receive either end section of the radial support member 120, however, the U-shaped notch depicted in, e.g., FIG. 2A, is optionally absent. Such an embodiment can be advantageous in certain circumstances where it is beneficial for the radial support arm 120 to pivot about the axis defined by the elongate vertical support member 115 as illustrated in FIG. 4. It will be understood, however, that this embodiment can include a vertical support member including the U-shaped notch as described in previous embodiments. Similarly, the reversibility of the system 100 shown in FIG. 4 is not precluded by the optional absence of the U-shaped notch in the vertical support member 115.

Referring now to FIGS. 5A-5E, in general, the vertical support member described herein can be built from one or more sectional members so as to provide adjustability in the length of the vertical support member, and, correspondingly, adjustability in the height of the radial support arm.

Figure 5A:
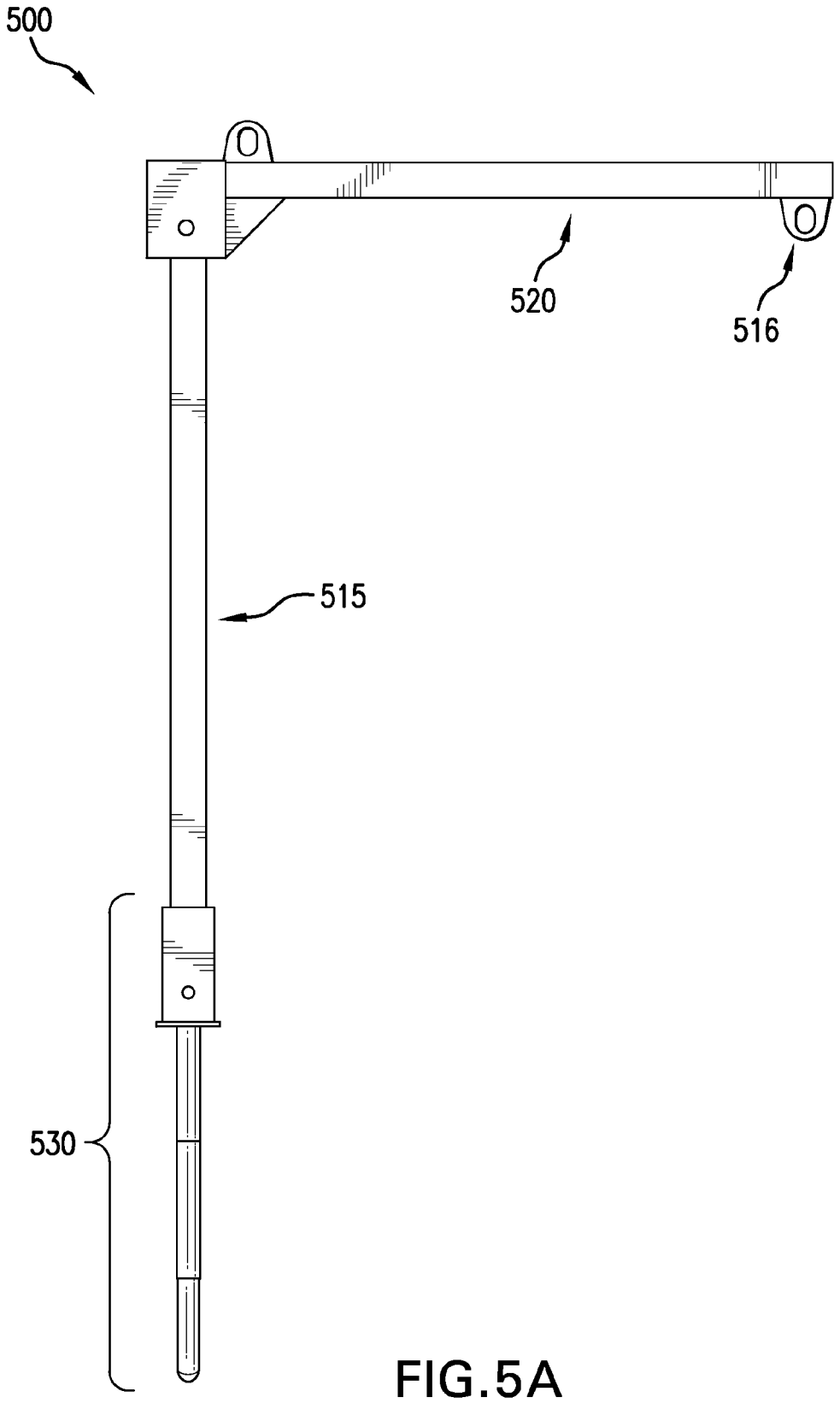
FIGS. 5A-5E depict components of variable-height attachment point systems according to multiple embodiments.

FIG. 5A shows an attachment point system 500, an assembled configuration, according to one embodiment. In this embodiment, the system 500 includes a vertical support member 515 and a radial support arm 520, similar to other embodiments described herein. Eyelet 516, disposed on a distal end of the radial support arm 520 can be used to attach a tether member of a safety harness to the system 500. Various components of other embodiments described herein can be exchanged for those illustrated in FIGS. 5A-5E; for example, vertical support member 115 and radial support arm 120 can be exchanged for the vertical support member 515 and radial support arm 520. Vertical support member 515 includes a sectioned, elongate support system 530 that is configured to be inserted into a support cone or other stabilizing receptacle. Such a support system 530 can be used, e.g., during framing construction, where the stabilizing receptacle can be a cone inserted into a concrete pillar and configured to receive the support system 530.

Figure 5B:
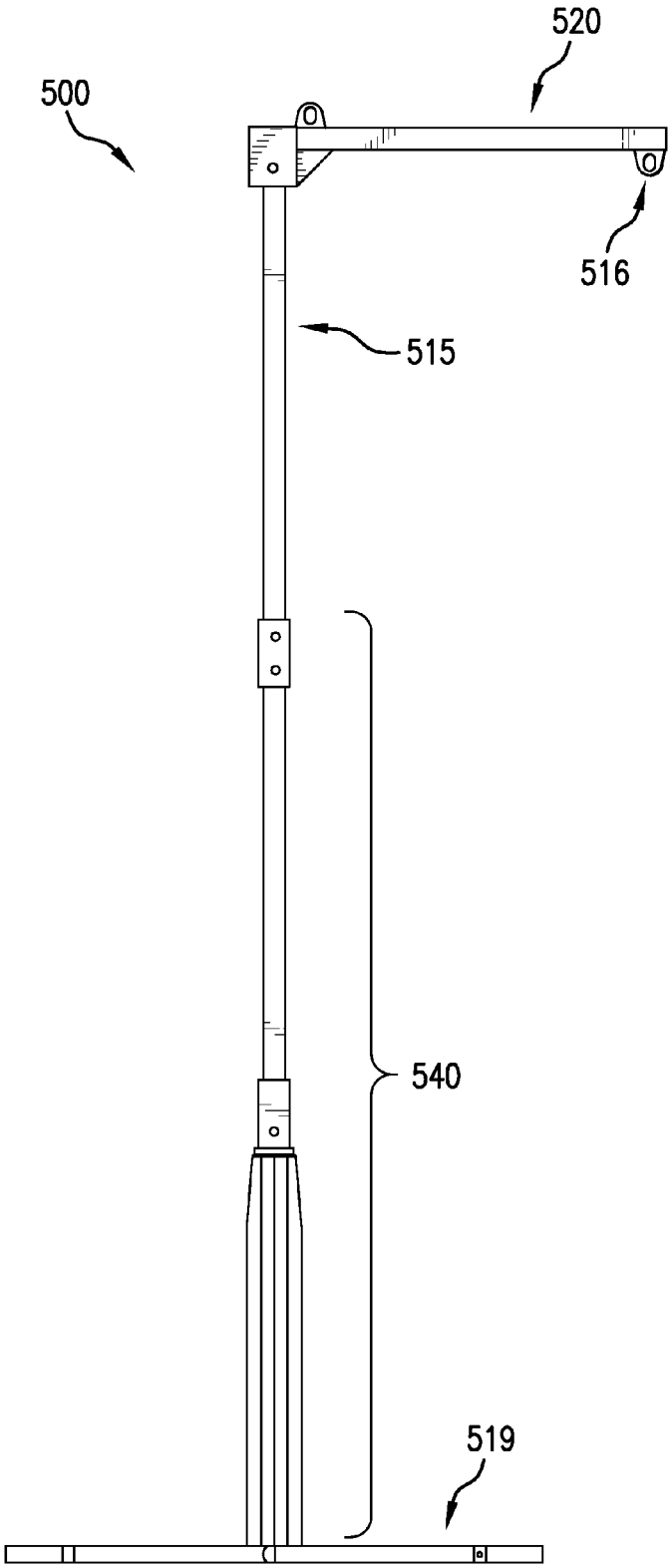

Referring now to FIG. 5B, the system 500 is shown with an exemplary support system 540 that can be used, e.g., in decking applications. In this embodiment, the support system 540 can be securely attached to a base as described in greater detail below. The base can be configured as needed to provide support for the system, and sand bags or other weights can be added on top of the base 519 for added stability.

Figure 5C:
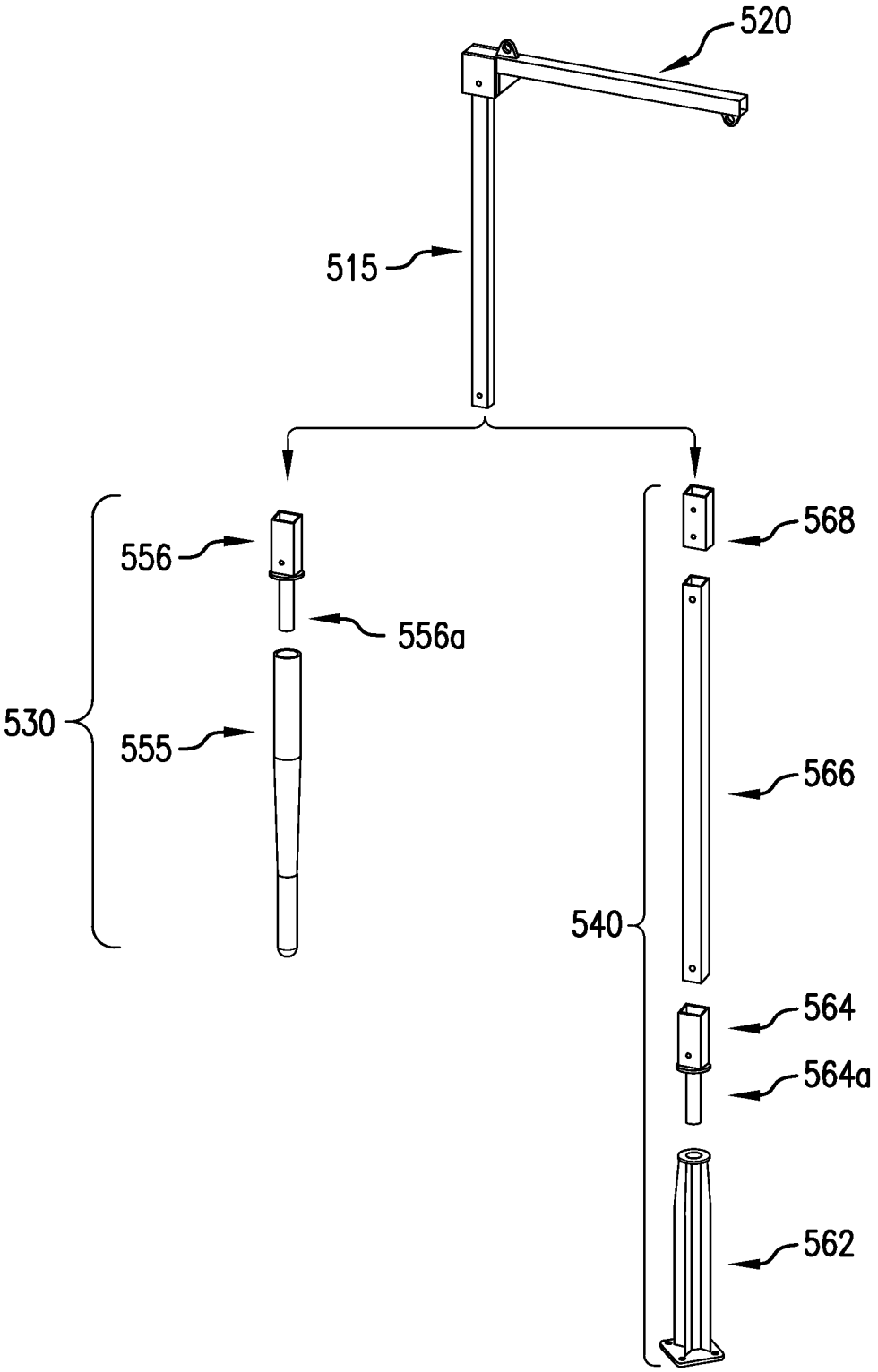

FIG. 5C shows the support systems 530, 540 in exploded views and demonstrates the inter-exchangability of the system 500 with support system 530 or 540, according to one embodiment. In this embodiment, support system 530 includes a footer 555, which can be a hollow, cone-shaped receptacle configured to securely receive a finger portion 556*a* of sectional member 556. The sectional member 556 can be formed of a resilient material such as steel and can have a substantially rectangular-tubular shape that is configured to receive the first end section 516 of the vertical support member 515. In this and other embodiments, the sectional member 556 can be of any desired length so that the user can adjust the height of the system 500 according to preference or operational considerations. Likewise, multiple sectional members 556 can be stacked in series, each of which can be of different lengths, if desired. Thus, FIG. 5A illustrates an assembled system 500 including the vertical support member 515, radial support member 520, sectional member 556, and footer 555 from FIG. 5C.

Referring now to FIG. 5C, similarly, the assembled system 500 in this embodiment includes support system 540 which is constructed from multiple segments, and illustrated in FIG. 5C in an exploded view. The support system 540 in this embodiment includes a first segment 562 having a substantially cylindrical recess configured to securely receive a finger member 564*a* of a second segment 564. The second segment 564 is a resilient material having a substantially rectangular-tubular shape and is configured to receive a third segment 566 therein. A fourth segment 568 is similarly constructed and is configured to linearly couple the third segment 566 to the vertical support member 515.

Figure 5D:
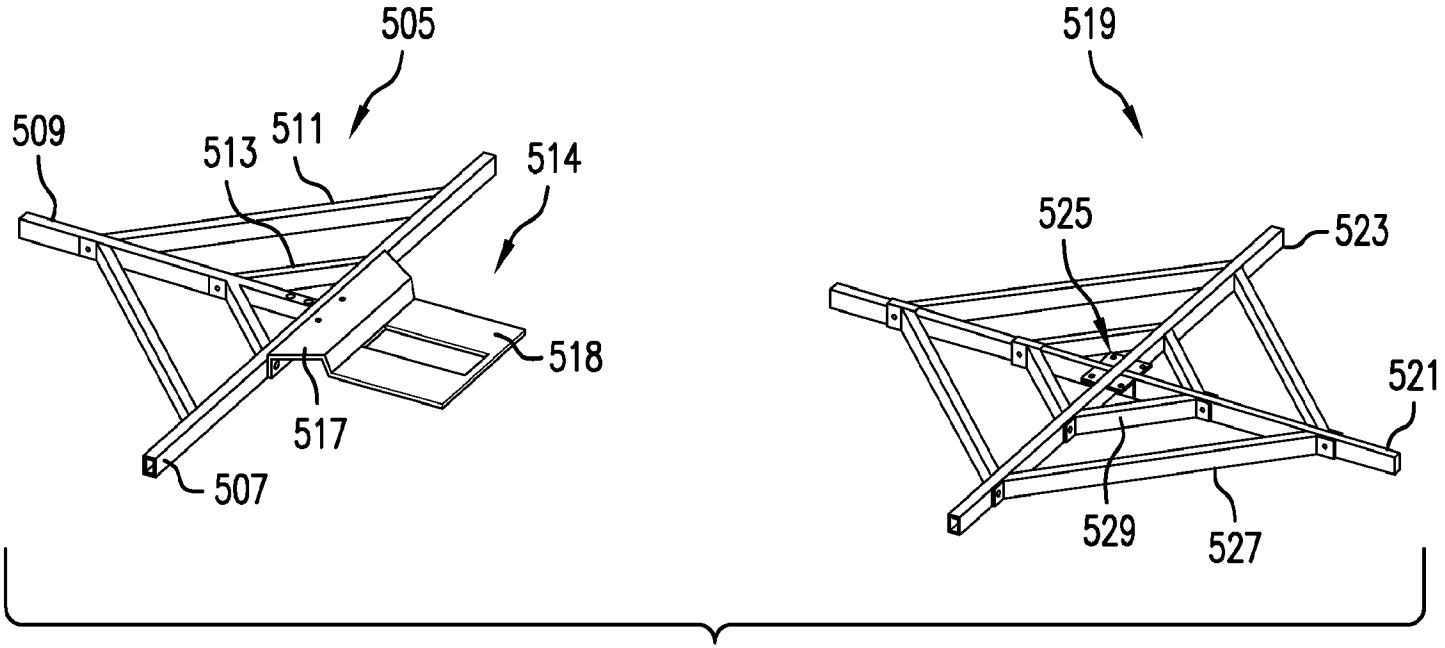
Figure 5E:
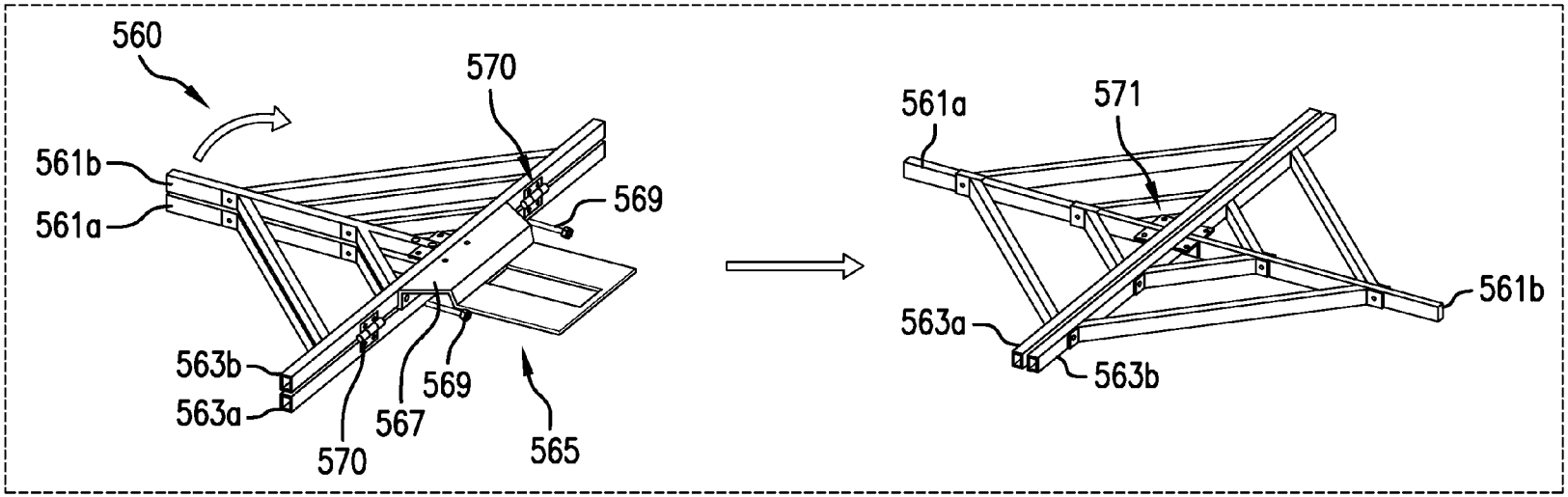

Referring now to FIGS. 5D-5E, various bases are illustrated according to multiple embodiments that can be securely attached to the elongate support member 515, or, for example, to the first segment 562 of the support system 540.

In the FIG. 5D embodiment, base 505 includes a first arm 507 and a second arm 509 that bisects and is secured to the first arm 507. A number of cross-braces, e.g., cross-braces 511, 513 provide added stability to the base 505 and form a cage structure. A wheel plate 514 includes a base 518 that is configured to receive a tire from a truck or other vehicle; a platform section 517 is securely attached to the first arm 507 as illustrated. A series of bolt holes, which may be threaded in some embodiments, are disposed on the platform 517 and the second arm 509 and configured to match the bolt hole pattern on the base of the first segment 562. In this embodiment, the weight from a truck or other vehicle can add stability to the system 500. Sand bags or other counterweights can be placed on cage structure to provide additional stability.

In another exemplary embodiment, a base 519 includes a first arm 521 and a second arm 523 that bisects the first arm 521, and includes cross-braces, e.g., cross braces 527, 529 to form a rigid cage structure as illustrated. In this embodiment, a centrally-disposed plate 525 is configured with bolt holes, which can be threaded bolt holes in some embodiments, so as to match the bolt hold pattern in the first segment 562. In this embodiment, stability of the system 500 can be increased by applying sandbags or other counterweights around the cage structure.

In the FIG. 5E, a base 560 can be reversibly folded to provide the functionality (including, e.g., portability and/or storage) of the first base 505 and second base 519 previously described. In this embodiment, the base 560 includes a first cage structure half, which includes a first arm 561*a* and a second arm 563*a* which are spanned by cross-brace members as described with respect to base 505. The base 560 further includes a second cage structure half, which includes a first arm 561*b* and a second arm 563*b* which are spanned by cross-brace members as described with respect to base 505. In this embodiment, the first and second cage structure halves are hingedly joined to allow the base 560 to be shifted between folded (left side) and opened (right side) configurations as illustrated by the arrow. In this embodiment, wheel plate 565, which can be similar or equivalent to wheel plate 514, can be attached as desired to the second arm 563*a* or 563*b* by bolts 569.

In one exemplary embodiment, the wheel plate can be substantially flat, i.e., absent the platform 567, so that the base 560 can be shifted between folded and unfolded configurations while the wheel plate 565 remains attached. In such an embodiment, the wheel plate can be attached, e.g., to the second arm 563*a*. In this embodiment, a centrally-disposed plate 571 includes bolt hole patterns as previously described to accommodate secure attachment of the first segment 162 to the base 560.

In this and other exemplary embodiments, the base 105 may be portable. For example, the base 105 can include one or more castor assemblies securely attached to one or more of the arms 507, 509, 521, 523 or the cross-braces 511, 513, 527, 529 so as to make the system 100 portable. For example, a user can roll the assembled system 100 to chosen locations by virtue of the castors.

Figure 6:
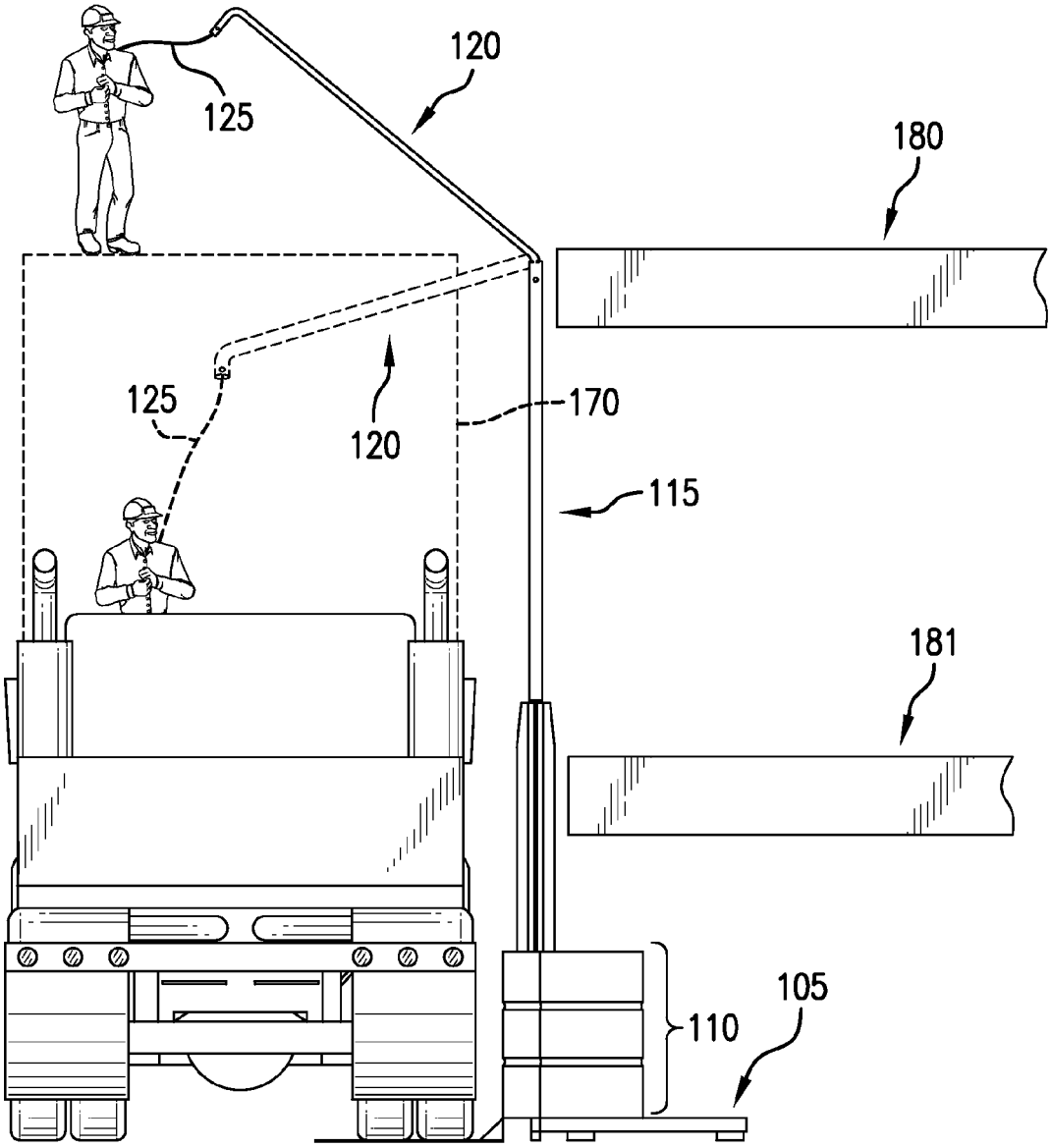
FIG. 6 depicts use of a variable-height attachment point system according to one embodiment.

Referring now to FIG. 6, the system 100 can be used in tractor-trailer off-loading procedures. FIG. 6 illustrates a rear-view of a tractor-trailer combination, where a worker is provided first (180) and second (181) plateaus from which to access a top of a trailer (illustrated in dashed lines) or the bottom of the trailer, respectively. As is known in the shipping industry, often times a worker is charged with the task of working on, or off-loading trailer contents from trailers of multiple heights. In this embodiment, a worker can attach their safety harness tether 125 to the attachment point of the radial support member 120 as previously described. Depending on the height of the trailer, the user can switch between a first radial support member orientation, and thus a first attachment point height (drawn in solid lines), and a second radial support member orientation, and thus a second attachment point height (drawn in dashed lines).

Figure 7:
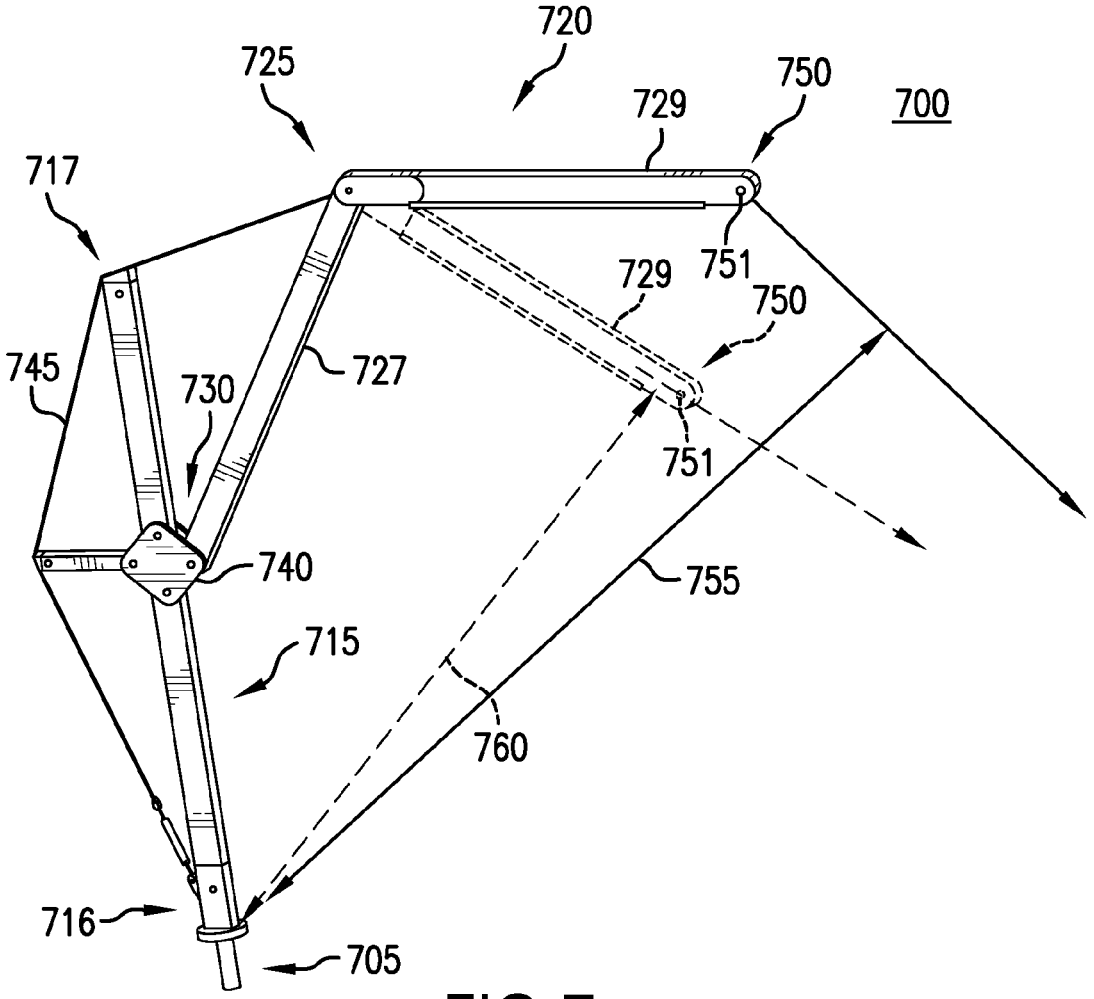
FIG. 7 depicts a variable-height attachment point system having a breakaway hinge according to one embodiment.

Referring now to FIG. 7, a variable-height attachment point system 700 is shown according to one embodiment. The system 700 includes a vertical support member 715 configured to removably couple to a footer 705 which itself can be affixed in cement or coupled to a base member (not shown in FIG. 7). A radial support arm 720 is slidably coupled to the vertical support member 715 via a coupler 740. The coupler can be, e.g., a ratcheting coupler that lockingly engages one or more sawtooth-shaped recesses (not illustrated in FIG. 7) disposed along the long axis of the vertical support member 715, so that a user can position a proximal end section 730 of the radial support arm 720 at a desired location.

In this embodiment, the radial support arm 720 is formed of first 727 and second 729 sections hingedly coupled by a breakaway hinge 725. In this embodiment, the second section 729 of the radial support arm 720 can collapse, e.g., shift from the first orientation (solid line in FIG. 7) to the second orientation (dashed line in FIG. 7) if the support arm is struck by machinery or another object that may otherwise cause structural damage to the system 700. Such situations can be hazardous for a worker attached to a safety support system, since a structurally-compromised system can fail, potentially fall from the structure and pull the worker down with it. In this embodiment, the collapsible radial support arm 720 is configured to both mitigate the force from an unintended strike by hingedly collapsing, and simultaneously maintain a stable tether attachment point for the worker.

In various embodiments, the breakaway hinge 725 can be a hinge that allows the second section 729 to hingedly shift from a first orientation to a second orientation when a threshold force is applied to the support arm 720, specifically, to a distal end section 750 of the radial support arm 720. In one embodiment, a shear pin configured to break at a certain threshold shear force can be utilized. In this embodiment, the distal end section 750 of the radial support arm includes an aperture 751 that serves as a connection point for a tether of a fall-arresting safety harness.

In this embodiment, the system 700 further includes a guy spanning from a first end section 716 of the vertical support member to a distal section of the first section 727 of the radial support member 720 proximal to the breakaway hinge 725 for supporting the first section 727 in an operable configuration, e.g., the configuration shown in FIG. 7.

Although not depicted in FIGS. 1-8C, it will be understood that any of the systems described herein, including equivalents and variants thereof can utilize a radial support member having a breakaway hinge as described with respect to FIG. 7 for the advantages it presents.

Referring now to FIGS. 8A-8G, a variable-height attachment point system 800 is depicted in an operational configuration, according to one embodiment. In this embodiment, an elongate vertical support member 815, which can be substantially equivalent to elongate vertical support member 115 previously described, is configured to support a radial support arm 820, which can be substantially equivalent to radial support arm 120 previously described. In this embodiment, the radial support arm 820 is coupled to the vertical support member 815 by a U-shaped clasp assembly 830, which is described in greater detail below. In this embodiment, the attachment point system includes a guy 840 which can be substantially equivalent to guy 140 previously described. A distal end 841 of the guy 840 terminates in a loop that is resiliently clasped to reduce the likelihood of the loop breaking open under pressure or other forces imparted onto it during operation.

In this embodiment, a distal end of the radial support arm 820 includes two U-shaped bolts 825, 827, each having two threaded arms protruding from a U-shaped base. The threaded arms extend through the cross-section of the radial support arm 820 and protrude on an opposite side of the U-shaped base to provide attachment points for a proximal attachment ring assembly 825*a*, and a distal attachment ring assembly 827*a*, as shown. In this embodiment, a reversibly-securable linking assembly 842 can conjoin the loop 841 to either the proximal (825*a*) or distal (827*a*) attachment ring. Exemplary linking assemblies 842 include, not by way of limitation, carabineers, quick-links, and other resilient linking mechanisms. It will be understood in this and other embodiments that while FIGS. 8A-8G illustrate two attachment ring assemblies 825*a*, 827*a*, in other embodiments, any desired number of attachment ring assemblies may be used. Furthermore, the illustrated U-shaped bolts, linking assembly, and attachment ring assemblies depict illustrative embodiments.

Figure 8A:
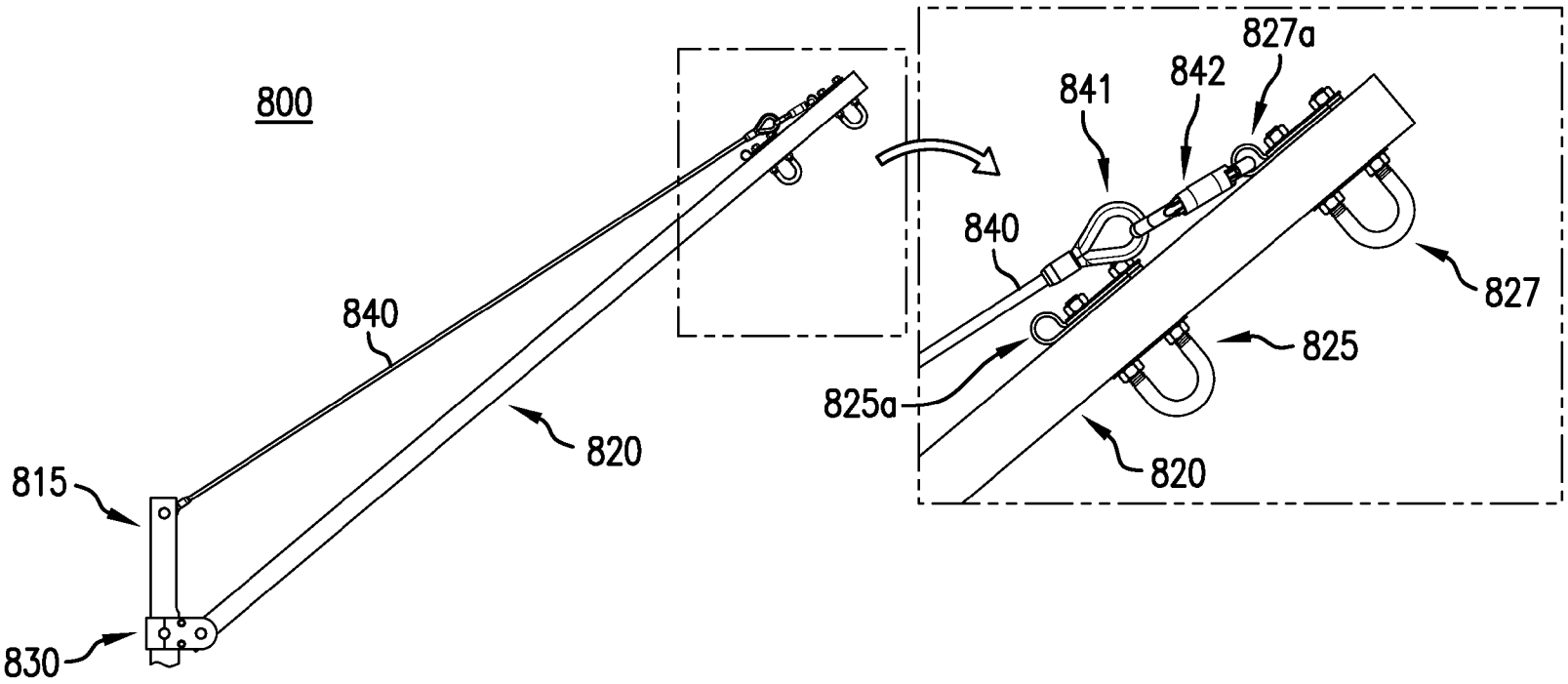
FIGS. 8A-8B depict a variable-height attachment point system according to one embodiment.
Figure 8B:
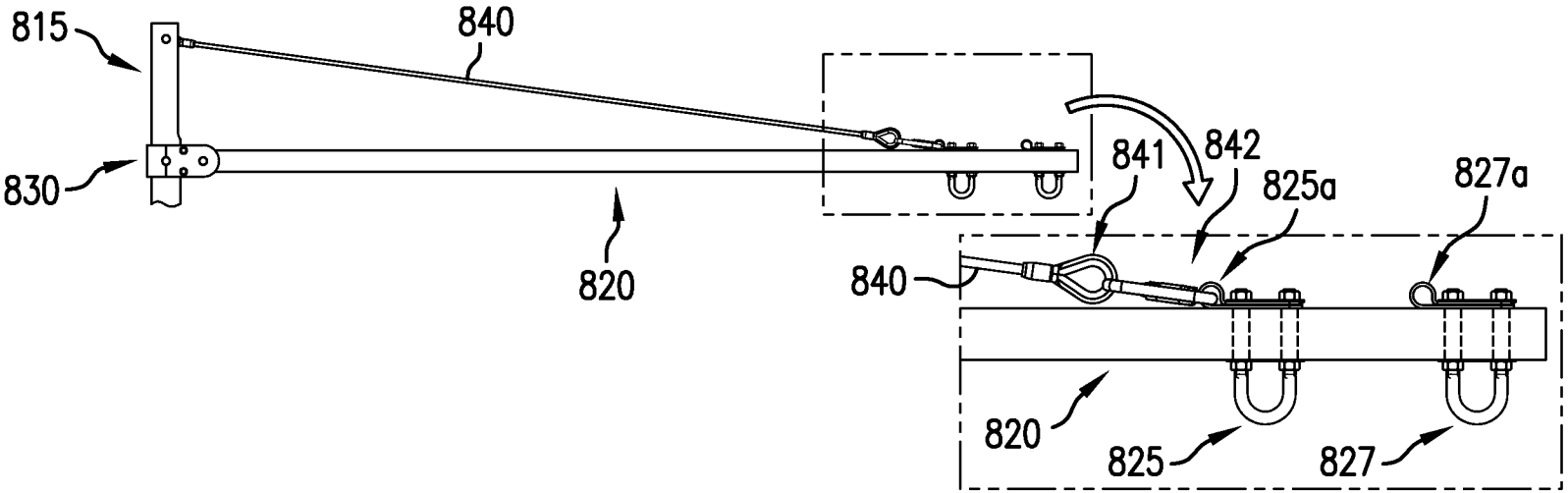

FIGS. 8A-8B depicts the variable-height attachment point system in two configurations: a high-point attachment configuration (upper), and a low-point attachment configuration (lower). As described herein, one advantage of the systems and methods provided is that a user can reversibly select between high-point or low-point connection configurations; in preferred embodiments, the transformation can be made by hand with little effort on the part of the user. In this embodiment, a user can switch between high- and low-point configurations by selectively attaching the linking assembly 842 to either the proximal (825*a*) or distal (827*a*) attachment ring assembly.

Figure 8C:
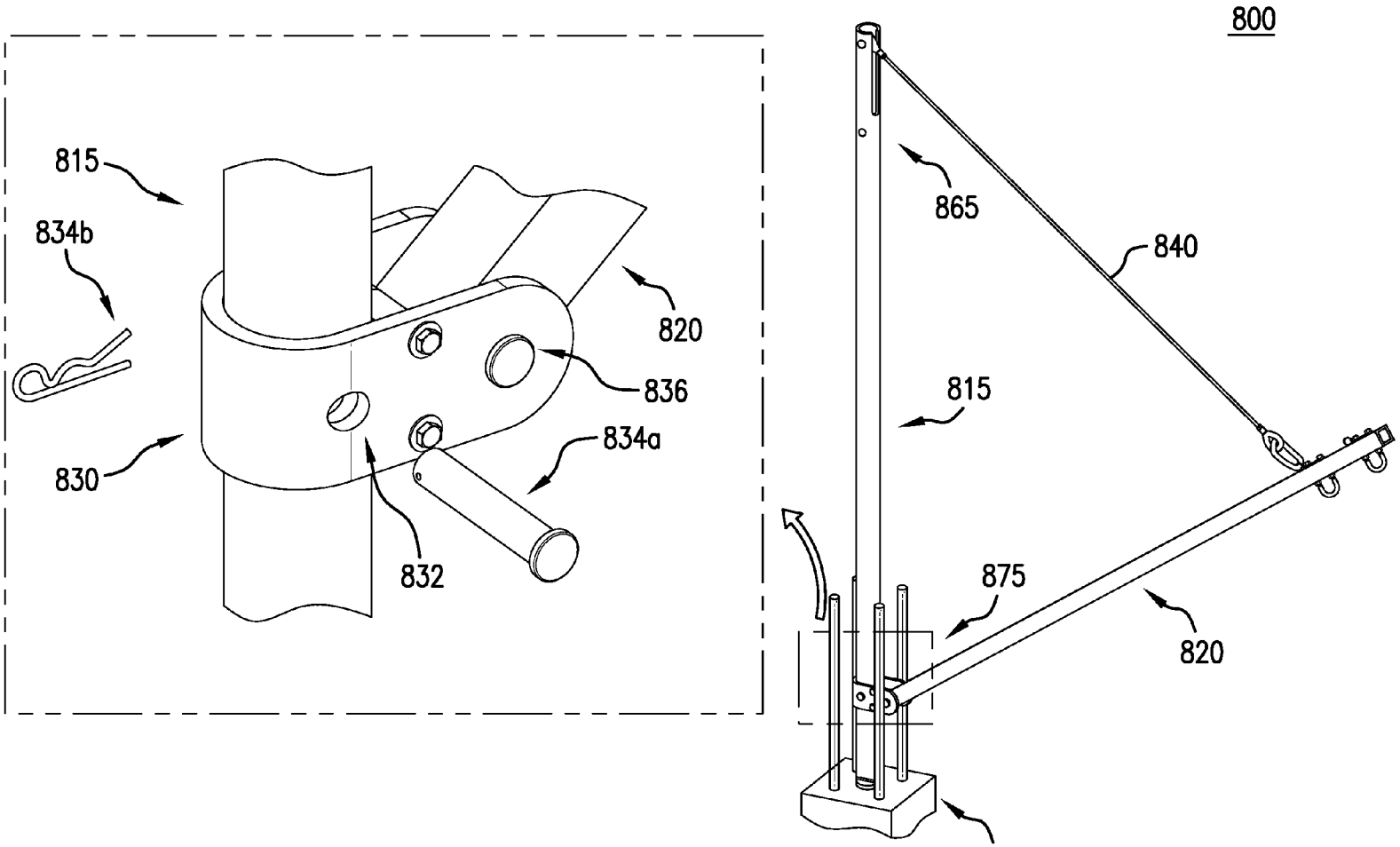
FIG. 8C depicts components of the variable-height attachment point system illustrated in FIGS. 8A-8B, according to one embodiment.
Figure 8D:
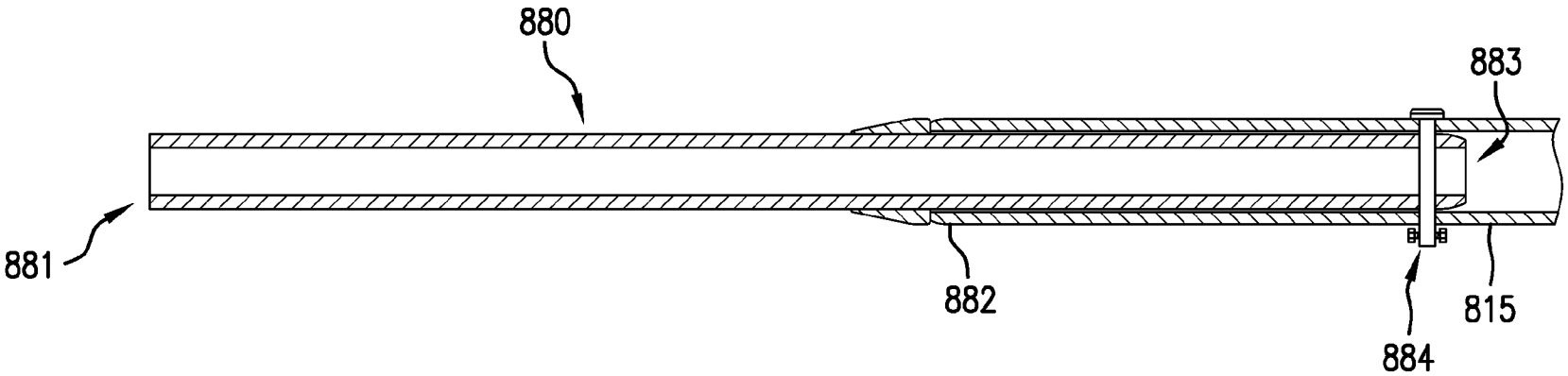
FIGS. 8D-8G depict components of the variable-height attachment point system illustrated in FIGS. 8A-8B, according to one embodiment.

Referring now to FIG. 8C, in this embodiment, the U-shaped clasp assembly 830 is capable of shifting along the vertical support member 815. The U-shaped clasp assembly 830 includes an aperture 832 through which a locking pin 834*a* can be inserted to secure the assembly 830 at a desired location along the length of the vertical support member 815. While not illustrated in FIG. 8C for figure clarity, the U-shaped clasp 830 includes two apertures, one of which (not shown) is opposite aperture 832, so that the locking pin 834*a* can extend completely through the vertical support member 815 and protrude from the opposite side of the U-shaped clasp 830. A cotter pin 834*b* or similar component can be used to secure the locking pin 834*a* in place. In this embodiment, a pin 836 secures the radial support arm 820 to the U-shaped clasp assembly 830 and allows the radial support arm to pivot within the U-shaped clasp when the assembly 830 is shifted along the vertical support member 815.

Referring back to FIGS. 8A-8B, the operational configuration depicted therein can be used for tethering a safety harness to either of the two U-shaped bolts 825, 827. To switch between low- and high-point configurations, the user can unlock the U-shaped clamp 830 from the top portion 865 of the vertical support member 815 and shift it toward the bottom portion 875. Doing so can allow the distal portion of the radial support arm to drop within reach of the user, so that they can selectively attach the linking assembly 842 to either the distal 827*a* (high-point) or proximal 825*a* (low-point) attachment ring assembly. The user can subsequently slide the U-shaped clamp 830 back to the top portion 865 of the vertical support member and lock it into place as previously described.

In some cases, it may be beneficial to utilize a U-shaped clamp 830 having a self-locking pin assembly that automatically snaps into locking engagement with locking apertures disposed on the top portion 865 of the vertical support member 815, in case the locking apertures are out of reach of the user. In one such example, a locking pin 834*a* can be engaged with the U-shaped clamp by one or more spring mechanisms. The spring mechanisms can provide constant urging force for the pin 834*a* to shift toward the opposite side of the U-shaped clamp, so that when the U-shaped clamp is positioned correctly at the top portion 865 of the vertical support member 815, the springs urge the pin through the vertical support member so as to protrude from the opposite side of the U-shaped clamp 830.

Referring now to FIG. 8D-8G, in this and other embodiments, the variable-height attachment point system 800 can include an adapter 880 for securing the lower portion 875 of the vertical support member 815. In this embodiment, the adapter 880 is an elongate tube configured to be received by a stabilizing receptacle 888 of similar dimensions. The stabilizing receptacle can be, e.g., a cone configured to be set into a pillar 886, such as a cement pillar. The adapter 880 includes a first end 881 configured to be inserted into the stabilizing receptacle 888 and a second end 883 configured to protrude from the stabilizing receptacle 888 and includes a throughput aperture for receiving a locking pin 884 or similar type of fastener to couple the receptacle 888 to the vertical support member 815 as shown.

Figure 8E:
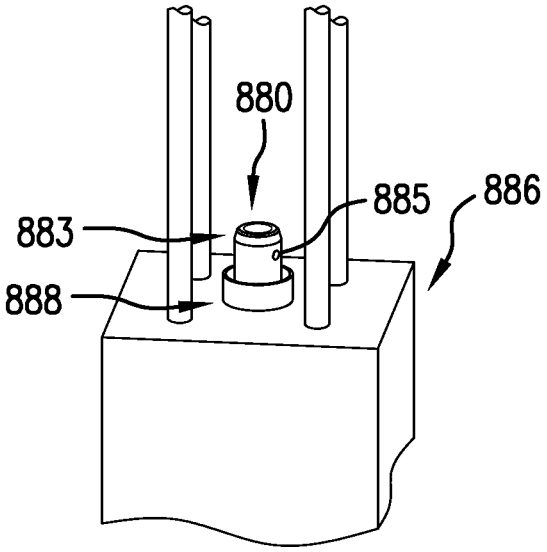
Figure 8F:
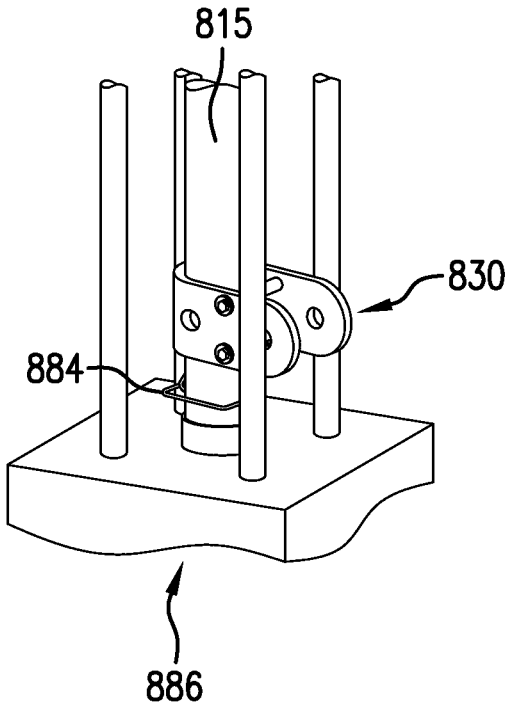
Figure 8G:
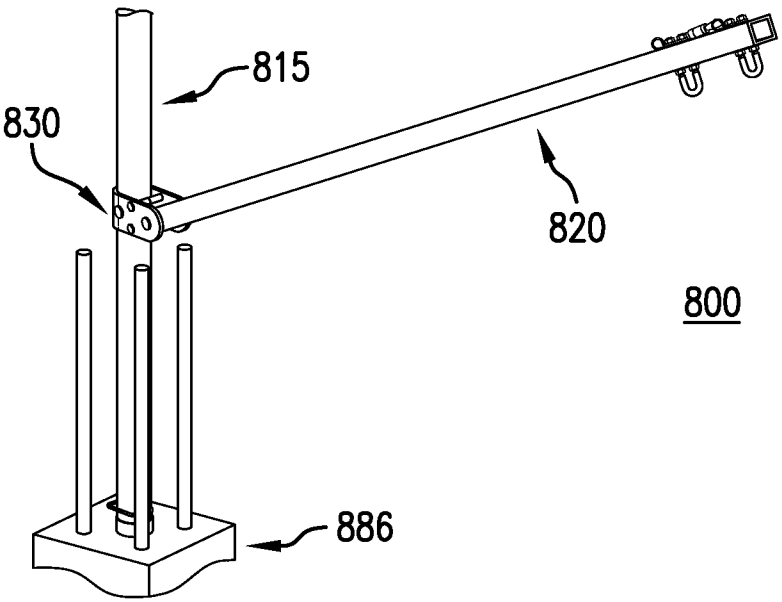

The adapter 880 can be used alone or with other components to attach the vertical support member 815 to any suitable base, including the pillar 886 as illustrated In this embodiment, a ring-shaped void is defined by the space between the outer circumference of the adapter 880 and the inner circumference of the stabilizing receptacle 888 which can receive the vertical support member 815. In this embodiment, the second end 883 of the adapter 880 includes a pair of oppositely-disposed apertures 885 (only one aperture is illustrated in FIG. 8E for clarity of the drawing) which are configured to align in complementary fashion to a pair of apertures on the vertical support member 815. A locking pin 884 or other suitable fastening mechanism can be used to secure the vertical support member 815 to the adapter 880 in an operational configuration as illustrated, e.g., in FIG. 8G.

Although various embodiments have been described with reference to the figures, other embodiments are possible. For example, the various components of the systems described herein, e.g., the vertical or radial support members, including segmented versions thereof, can be formed from suitable materials according to its intended use. Additionally, any feature, component, or description in one embodiment can be applied to another embodiment for the advantages that may be apparent to skilled artisans. The various components of the described systems can be interchangeable. For example, the various bases and footers described herein can receive, or be adapted or configured to receive an end portion (e.g., end portion 116) of a vertical support member 115. In various embodiments, the disclosed footers and bases can include rotational bearings or otherwise provide rotational mobility of the vertical support member so that the radial support member can freely rotate to follow a user as he moves about the work surface.

In one embodiment, a system can include shock absorbers to reduce the likelihood of trauma from arresting forces if a user falls from a work surface.

In various embodiments, the described components can be formed from steel, including tubular steel, e.g., rectangular-tubular, cylindrical-tubular, etc., although other materials can be substituted according to preference or other considerations. The figures are not necessarily drawn to scale. Thus, any component of any system or embodiment described herein can be sized according to user preference according to the intended use of the system or embodiment. The systems described herein can be adapted or configured to cooperate with a specific type of safety harness system not described herein. In some cases, multiple systems and embodiments can be used simultaneously by a plurality of users. While specific reference has been made to the construction and transportation industries, other use of the disclosed systems and methods are equally contemplated in other industries and recreational activities. For example, a system of the type described herein can be used as fall-arrestor for recreational climbing walls.

In various embodiments, apparatus and methods may involve coupling a vertical support member (e.g., vertical support member 115) directly to a stabilizing structure. In a related embodiment, a vehicle such as a fire engine can include a recess configured to receive and secure an end portion of a vertical support member on the side of the engine. Such an embodiment can provide a variable-height attachment point for a safety harness worn by firefighters when operating on top of the engine, e.g., when re-loading hose or ladders.

In various embodiments, the attachment point can be adapted or configured to cooperate with any type of safety harness. For example, the attachment point can be an aperture of any size, as previously described, or the attachment point can include, without limitation, integral connection mechanisms such as clips, hooks, clamps, couplings, keepers, and/or latches, for example.

In various embodiments, the system can include a vertical support member of sufficient height to provide clearance above a worker, and can have an attached radial support member to provide a connection point at an appropriate horizontal distance from the base anchor point. The radial support member can be connected to the vertical support member in such a way as to prevent deflection by means of increased stiffness produced by web, guy line, or structural support members. In some embodiments, the horizontal member and the vertical member can substantially resist deflection under forces that may be imparted to the system during a fall protection scenario. In some cases the anchor point may support up to at least approximately 1800 pounds or more, for example.

In one embodiment, the base of the vertical support member can be reinforced, and can interface with the base by means of an easily rotatable connection point, such that the vertical member can stay completely vertical, and can rotate easily with the force applied to the attachment point by a human. In various embodiments, the base or footer can be 1) a metal cone which can be embedded in concrete; 2) a metal cone mounted to a metal anchor which attaches to a beam by means of, for example, a clamp, bolt; 3) a modular flat base upon which specified weight can be placed and secured, whether in a specified container, or of a specified material of specified weight; and/or 4) a flat base upon which both integral counter-weight and a vehicle of specified weight can be parked to provide a working weight.

Various embodiments may include structures for reversibly coupling first or second end sections of a radial support member to a receptacle at an end section of a vertical support member in a fall protection system as disclosed herein. For example, referring to FIGS. 1, 2, 3A, 3B, 4, and 6, vertical support member 115 includes an end section 117 having a U-shaped notch 119 configured to receive either end section 121, 122 of radial support member 120. Furthermore, the end section 117 of vertical support member 115 includes an aperture 131 configured to co-align with an aperture, e.g., aperture 124, disposed in either end section 121, 122 of the radial support member 120 when either end section 121, 122 is inserted into the U-shaped notch 119. A fastening mechanism 138, which can be a bolt, cotter pin, for example, can be used to reversibly couple either end section 121, 122 of the radial support member 120 to the end section 117 by passing the fastening mechanism through both apertures 131, 124 as shown. It will be understood that, while not shown for figure clarity, the first end section 121 of the radial support member 120 includes an aperture similar to aperture 124 disposed on the second end section 122.

Various embodiments may include structures for selectively positioning a safety harness attachment point at an operator selectable height in a fall protection system as described herein. For example, referring to FIGS. 1, 2, 3A, 3B, 4, and 6, the radial support member 120 includes two end sections 121, 122 having bends $\theta_1$ and $\theta_2$ respectively, where $\theta_1 \neq \theta_2$. Each end section 121, 122 includes an aperture 124 (the aperture in the first end section 121 is not shown for figure clarity) that can be used as an attachment point for a safety harness. Because each end section is bent at a different angle, the attachment point will be disposed at different heights depending on which end section 121, 122 is reversibly coupled to the vertical support member 115. An operator can thus choose between at least two safety harness attachment point heights by coupling either of the two end sections 121, 122 of the radial support member 120 to the end section 117 of the vertical support member 115.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A fall protection system, comprising:

an elongate, vertical support member defining a vertical axis comprising first and second oppositely-situated end sections, a support base having a coupler to removably receive said first end section and to support said fall protection system in a substantially upright and operable configuration; and a radial support member having first and second oppositely-situated end sections spanned by a major elongate central member substantially coplanar with said end sections of the radial support member, wherein each of said radial support member end sections comprises a bend in said major elongate central member at first and second bend angles respectively, wherein said first and said second bend angles are non-equal, and wherein said first radial support member end section is configured to provide a first attachment point and said second radial support member end section is configured to provide a second attachment point, and wherein said first and second attachment points are configured to provide at least one of either a connection for a tether or for lifting said fall protection system, wherein said second end section of said vertical support member is configured to removably and coaxially secure to either one of said first and said second end sections of said radial support member in a first or a second configuration respectively, wherein, when in said first configuration, an angle between said vertical support member and said major elongate central member is approximately equal to said first bend angle, and when in said second configuration, said angle between said vertical support member and said major elongate central member is approximately equal to said second bend angle, wherein, when in said second configuration, said second attachment point corresponding to said second end section is positioned substantially at a center of gravity of a combination of said vertical support member secured to said radial support member such that said vertical support member hangs substantially parallel to a gravity vector when said combination is lifted at said corresponding second attachment point.

2. The fall protection system of claim 1, wherein said first and said second attachment points are respectively positioned proximal to said first and second end sections of the radial support member, respectively.

3. The fall protection system of claim 2, further comprising a guy spanning said second end section of said vertical support member and said first or second attachment points at an unsecured end section of the respective first and second end sections of said radial support member and connected therebetween.

4. The fall protection system of claim 2, wherein, when in said first configuration, said first attachment point corresponding to said first end section is positioned substantially at the center of gravity of a second combination of said vertical support member secured to said radial support member such that said vertical support member hangs substantially parallel to a gravity vector when said second combination is lifted at said corresponding first attachment point.

5. The fall protection system of claim 1, wherein said first bend angle is between about 80° and about 150°.

6. The fall protection system of claim 1, wherein said second end section of said vertical support member further comprises a receptacle configured to receive either of said end sections of said radial support member.

7. The fall protection system of claim 6, wherein said vertical support member and said radial support member are formed from a tubular structural material, and said receptacle is partially defined by a substantially U-shaped notch in said tubular structural material that originates at a terminal end of said second end section of said vertical support member and extends toward said first end of said vertical support member.

8. The fall protection system of claim 1, wherein each of said end sections of said radial support member comprises an attachment point aperture positioned adjacent a terminus of a respective end section of each of said end sections.

9. The fall protection system of claim 8, wherein said second end section of said vertical support member further comprises one or more apertures for receiving a locking member there through, and positioned to be axially aligned with said attachment point aperture when one of said first and second end sections of said radial support member is received by said second end section of said vertical support member and arranged in a secured configuration.

10. The fall protection system of claim 1, wherein said support base further comprises a portable base assembly.

11. The fall protection system of claim 10, wherein said portable base assembly further comprises a cage assembly for receiving one or more weights for stabilizing said fall protection system.

12. The fall protection system of claim 11, wherein said cage assembly is configured to receive said weights on a first cage assembly section and further comprises a second cage assembly section configured to receive and bear a weight of a vehicle.

13. The fall protection system of claim 12, wherein said second cage assembly section is hingedly coupled to said first cage assembly section to selectively deploy in a folded or in an open configuration.

* * * * *